United States Patent [19]

Brown et al.

[11] 4,071,084

[45] Jan. 31, 1978

[54] WELL PACKER

[75] Inventors: Joe R. Brown; Chudleigh B. Cochran, both of Houston, Tex.

[73] Assignee: Brown Oil Tools, Inc., Houston, Tex. ; by said Chudleigh B. Cochran

[21] Appl. No.: 750,801

[22] Filed: Dec. 15, 1976

[51] Int. Cl.[2] ..... E21B 23/00; E21B 33/12

[52] U.S. Cl. ..... 166/129; 166/139; 166/182; 166/315

[58] Field of Search ..... 166/129, 138, 139, 140, 166/216, 182, 315

[56] References Cited

U.S. PATENT DOCUMENTS

| | | | |
|---|---|---|---|
| 3,171,490 | 3/1965 | States | 166/139 |
| 3,256,437 | 6/1966 | Muse | 166/139 |
| 3,289,766 | 12/1966 | Bigelow | 166/139 |
| 3,294,172 | 8/1963 | Brown | 166/139 |

*Primary Examiner*—James A. Leppink
*Attorney, Agent, or Firm*—Browning, Bushman & Zamecki

[57] ABSTRACT

Disclosed is a retrievable, weight set well packer which may be tightened in set configuration by rotation of the tubing string, and which may be released from set configuration by longitudinal movement of the tubing string. Locking means maintain the packer set when the tubing string is raised slightly to open a bypass between the tubing string and the set packer. Continued raising of the tubing string releases the locking means to permit the packer to be retrieved. Dual opposed spreader cones keep the packer set against well pressure differentials acting from either above or below the packer. Pressure responsive means are also employed to increase the forces anchoring the tubing string against movement to open the bypass as differential well pressures tend to so move the tubing string.

49 Claims, 13 Drawing Figures

WELL PACKER

BACKGROUND OF THE INVENTION

1. Field of the Invention

The present invention relates to well packer apparatus and methods for sealing tubing strings in wells as customarily used in the production of petroleum effluents from wells. The packer is used to seal the annulus between the well casing and the production tubing string through which the well effluents flow to the surface. Such packers are sometimes employed to provide seals for injecting fluids into the well and for a variety of other purposes.

2. Description of the Prior Art

Well packers have been developed to seal a conduit, or tubing string, to a surrounding well casing. Such packers are well known in the art for a variety of uses, including establishing a production tubing string within a well. The packer may be constructed to be anchored to the well casing in addition to supplying the necessary sealing means.

The packer is run in the well, or lowered, to a desired location, connected to a tubing string in an unset configuration, that is, exhibiting no sealing or anchoring engagement with the surrounding well casing. Then,the packer apparatus may be operated to lock the packer in place, and to provide a fluid-tight seal between the well casing and the packer itself. Such a setting procedure may be carried out in a variety of ways, the choice of which is related to the construction of the packer apparatus. In particular, weight-set packers employ the weight of the tubing string above the packer, when the packer has been lowered to the desired setting location, to manipulate the packer elements to achieve the set condition. The packer may be anchored to the well casing by effecting a radial expansion of an array of slips, which are pressed against the casing wall. In conjunction with the expansion of the slip array, resilient seals are forced into position between the body of the packer and the well casing. The packer must be fixed in this set configuration to prevent pressures within the well from moving the packer vertically, or otherwise disturbing the sealing and/or anchoring engagement between the packer and the well casing.

It may be necessary to subsequently re-set the packer at another location within the well, or to remove the packer from the well completely. Thus, it is particularly advantageous to construct the packer so that it is retrievable. Consequently, the packer must be able to be released from the set configuration, and returned to the configuration in which it was originally run in the well. Thus, the seals and the anchoring slips must be retractable from engagement with the well casing and the packer once again able to be moved by, say, manipulation of a tubing string.

Once the packer is set, and without disturbing its set condition, it may be necessary to move fluids beyond the packer in the annular region between the tubing string, which the packer seals to the well casing, and the well casing itself. Thus, a bypass may be provided by the packer apparatus, and which may be selectively opened or closed. Consequently, additional fluid-tight sealing must be provided to close off the bypass from fluid flow when desired.

Weight set packers constructed to provide the aforementioned features may be manipulated by longitudinal movement of the tubing string, or rotational movement of the tubing string, or a combination. Examples of packers involving such movement may be found, for instance, in U.S. Pat. Nos. 3,279,542; 3,357,489; and 3,420,306 to C. C. Brown, and No. 3,467,184 to Young.

Packers set in a well casing may be subject to large pressure differentials across the set seals due to the condition of the fluid in the annular region between the tubing string and the well casing. Such pressure differentials may, in general, occur with the resulting net force acting on the packer either from above or below the seals. Each of the aforementioned patents discloses one form or another of setting means by which the anchoring slips are urged outwardly against the well casing by wedging action from both vertical directions. That wedging action, when appropriately linked to the portions of the packer body experiencing the pressure differentials tending to move the packer, may be employed to resist the net forces resulting from the pressure differentials. Such packer construction is particularly shown in U.S. patent application Ser. No. 612,226, filed Sept. 10, 1975.

Similarly, the same type of pressure differentials in the annular region between the tubing string and the well casing may also tend to disturb the setting of the tubing string in relation to the opening or closing of the bypass. Consequently, it is desirable to provide means by which the seals which close off the bypass may be retained in sealing position in the face of such pressure differentials. The aforementioned U.S. patent application Ser. No. 612,226 filed Sept. 10, 1975 discloses a pressure compensation means which employs a split ring and piston arrangement responsive to the pressure differential tending to unseat the bypass seal. The pressure differential forces the piston to bear against the split ring to ultimately hold the bypass seal in position to close off the bypass. U.S. Pat. No. 3,659,647 shows a plurality of radially movable pistons acting in conjunction with a split, annular snap ring to maintain a packer in set position rather than to maintain a bypass closed. In that case, a pressure differential across the packer seals, with excess pressure from below the seals, acts on the pistons to maintain the mandrel passing through the packer body fixed relative to the set packer body. Neutralization, or reversal, of the pressure differential, or rotation of the tubing string relative to the set packer, permit the release of the packer from its set condition. A modified form of the mandrel hold-down assembly is shown in the same patent. An annular, axially movable piston cooperates with an annular, split snap ring to react to the same pressure differential, with increased pressure below the set packer, to drive the snap ring into tight, threaded engagement with the mandrel passing through the packer body. The snap ring, in turn, is limited in its vertical movement by an element of the set packer body. To release the mandrel, and the tubing attached thereto, for vertical movement, the pressure differential may be reversed, or the mandrel may be unthreaded from the snap ring.

It will be appreciated that, in a packer of a type wherein the anchoring slips as well as the sealing means are both set by relative movements of various packer elements, the maintenance of both the anchoring and sealing means in setting configuration may be critical. Thus, for example, once set in sealing engagement with the well casing, the sealing means of the packer may not be able to maintain a sufficiently fluid-tight seal unless the mechanism which forces the seal into sealing engagement with the well casing is itself held tightly enough in set configuration. In the case of a weight set packer, these setting forces, as well as those which maintain the anchoring slips in set configuration, may depend entirely on the weight of the tubing string by which the packer is lowered into position in the well casing. Thus, since the amount of this tubing string employed depends upon the depth to which the packer is lowered for setting, the setting forces themselves may then depend upon the location of the packer in the well. Hence, in relatively shallow wells, the weight of the tubing string may be inadequate to set the packer with sufficient forces.

SUMMARY OF THE INVENTION

The apparatus of the present invention includes sealing means for selectively effecting sealing engagement within a conduit, body means including first and second components such that the sealing means may be set in sealing engagement with the conduit by a first phase motion of the first and second components toward each other, and tightening means for increasing the forces holding the sealing means in sealing engagement with the conduit, operable by a second phase motion of the two components toward each other effected by relative rotational motion between the two components. The method of the present invention includes steps of positioning a packer in a well on a tubing string, setting the packer by longitudinal movement of the tubing string relative to the well, and tightening the packer in set configuration by rotation of the tubing string. The packer may be released from the set and tightened configuration by longitudinal movement of the tubing string relative to the well.

The well packer of the present invention features a novel mechanism for increasing the forces maintaing the packer sealed and anchored to the well conduit in which the packer is positioned and set. Sealing means, carried by the packer, are extendable between a non-sealing configuration and a configuration in which the sealing means engage the well conduit to provide a fluid seal, thereby preventing fluid flow along the well conduit between the packer and the wall of the conduit. Anchoring means, also carried by the packer, are extendable between a non-anchoring configuration and a configuration in which the anchoring means engage the well conduit, thereby anchoring the packer against movement relative to the well conduit. The packer is considered set within the well conduit when the sealing means and the anchoring means respectively are in sealing and anchoring engagement with the well conduit. Then, locking means maintain the packer in the set condition, and rotation of the tubing string by which the packer was positioned within the well conduit may be effected to increase the forces by which the sealing means and the anchoring means respectively engage the well conduit.

A primary flow passage is defined for conducting fluids through the packer. A secondary flow passage, for bypassing fluids through the packer when the packer is set, may be selectively opened or closed by longitudinal movement of the tubing string relative to the well conduit. A snap lock, in the form of a split ring, carried by the packer, engages a mandrel, carried by the tubing string, when the secondary flow passage is closed to maintain that condition.

During the setting procedure, first and second components of the packer are telescoped together to extend slips of the anchoring mechanism and packer seals of the sealing means. With the packer thus set, and the first and second components mated together, an underlying locking sleeve is moved to locking position. The locking sleeve cooperates with a split ring locking slip to provide a ratchet-like arrangement which holds the mated portions in telescoped configuration so long as the locking sleeve remains in locking position.

The primary flow passage is defined within a mandrel extending through the packer, and which constitutes an extension of the tubing string on which the packer is positioned within the well conduit. The secondary flow passage is defined between the mandrel and the well conduit to bypass fluids through the packer when the latter is in set configuration. A range of longitudinal movement of the mandrel, and, therefore, of the tubing string, relative to the set packer and the well conduit is defined to permit opening and closing of the secondary flow passage by such motion. Raising the tubing string beyond the limit of this range moves the locking sleeve to a release position wherein the effect of the locking slip may be overcome, permitting the telescoped packer components to return to their original positions. The packer may then be retrieved by a continued straight upward pull of the tubing string.

In the operation of setting the packer, wherein the first and second components of the packer are telescoped together, upper and lower cones, or camming surfaces, wedge the slips of the anchoring mechanism radially outwardly into anchoring engagement with the well conduit. Also, upper and lower seal retainers longitudinally compress the annular, resilient seals, thereby causing radially outward extension of the seals with consequent sealing engagement with the well conduit. It will be appreciated that as the forces moving the first and second packer components together are increased, the forces causing the radial extension of both the slips and the seals of the packer against the well conduit increase. In the present invention, initial telescoping of the first and second packer components to set the packer may be effected by simply letting the weight of the tubing string above the packer bear on the first component while the second component is in frictional engagement with the well conduit. Once the packer is thus set, with the first and second components mated and the locking sleeve in locking position, the first and second components may be further telescoped to generate the aforementioned increase in forces effecting sealing and anchoring engagement with the well conduit. The ratchet connection between the locking slip and the first component of the packer includes intermeshed helical grooves on these two elements. The locking slip is also threaded to the second component of the packer, but is blocked against further movement along the second component by a set screw preventing rotation of the slip. Consequently, by rotating the first packer component relative to the second component when the two components are mated through the locking slip, these two components are drawn together. As a result of such continued telescoping motion of the first and second packer components, the anchoring slips and the seal means are further pressed against the well conduit, as noted hereinbefore. To selectively effect such rotation of the first packer component, the mandrel means carries a clutch mechanism equipped with one or more teeth which intermesh with a corresponding tooth arrangement carried by the first packer component. Thus, the packer may be tightened in its set configuration by selective rotation of the mandrel, carried out by rotating the tubing string connected thereto, and such tightening, or increase in the setting forces, may be produced regardless of the actual weight of the tubing string above the packer.

Pressure compensation means, in the present invention, includes the snap lock carried by the first, or upper, component of the packer. The snap lock is made responsive to pressure differentials, acting across the set packer in the well conduit, tending to move the tubing string relative to the well conduit to open the secondary flow passage. In such case, the pressure differential generates forces ultimately acting on the snap lock with components directed radially inwardly, urging the locking ring against the mandrel. The snap lock is lined internally with threads, which mesh with matching threads carried by the mandrel when the mandrel and tubing string are in position to close off the secondary flow passage. The two sets of threads may be meshed by rotation of the mandrel, through the tubing string, relative to the first packer component. However, a straight vertical pull on the tubing string frees the mandrel from the snap lock. This latter action is possible due to the fact that the snap lock is split, and is capable of sufficient expansion to allow unmeshing of the threads. An annular beveled surface on the snap lock, facing generally downwardly and radially outwardly, is exposed to an oppositely facing beveled surface on a seat member in the form of an annular piston, which cooperates with appropriate seal means to close off the secondary flow passage. This seat member is exposed to fluid pressure along the closed secondary flow passage, from below the set packer. Any pressure differential across the set packer in the annular region between the well conduit and the mandrel ultimately bears on the seat member. When the pressure differential is such that pressure from above the set packer is greater than pressure from below, the mandrel is urged in the direction which tends to maintain the secondary flow passage closed. When the pressure differential is such that the greater fluid pressure is below the seat member, and the mandrel and tubing string might otherwise be urged to move longitudinally relative to the well conduit to open the secondary flow passage, the fluid pressure differential acts on the seat member, driving it upwardly, and causing a longitudinal force to be transmitted thereby against the snap lock. The action of the beveled surface of the seat member against the facing beveled surface of the snap lock results in forces acting on the snap lock which have components directed radially inwardly toward the mandrel. Thus, a pressure differential resulting in excess pressure below the seat member results in the snap lock closing more tightly about the mandrel, thereby holding the mandrel by greater force fixed against longitudinal movement relative to the packer first component. In this way, as the forces urging the mandrel and tubing string to move longitudinally to open the secondary flow passage are increased due to the pressure differential in the well conduit, the forces which hold the mandrel fixed relative to the first packer component are increased. This insures that the bypass secondary flow passage will not be opened under pressure differential conditions.

It will be appreciated that the pressure compensating means in the present invention feature simplicity of design and relatively low cost of manufacture. The production of lateral forces from longitudinally directed forces is accomplished relatively directly, and in an uncomplicated fashion. By setting the facing beveled surfaces of the split locking ring and the seal member at 45° relative to the longitudinal axis of the packer, efficiency of the pressure compensating means is maximized. Furthermore, once the split ring and seat member have made contact therebetween, there is virtually no motion involved in operation of the pressure compensating means of the present invention. Furthermore, a pressure differential in the opposite direction, that is, with net forces tending to drive the mandrel and tubing string downwardly in the well conduit, simply results in the mandrel forcing the split locking ring downwardly against the seat member, which in turn is held by the first packer component. Again, the beveled surfaces of the split locking ring and the seat member act to wedge the split locking ring against the mandrel, so that increased pressure from above the packer results in increased forces tending to hold the mandrel and tubing string fixed against longitudinal motion relative to the set packer and the well conduit.

DESCRIPTION OF PREFERRED EMBODIMENTS

Figure 1A:
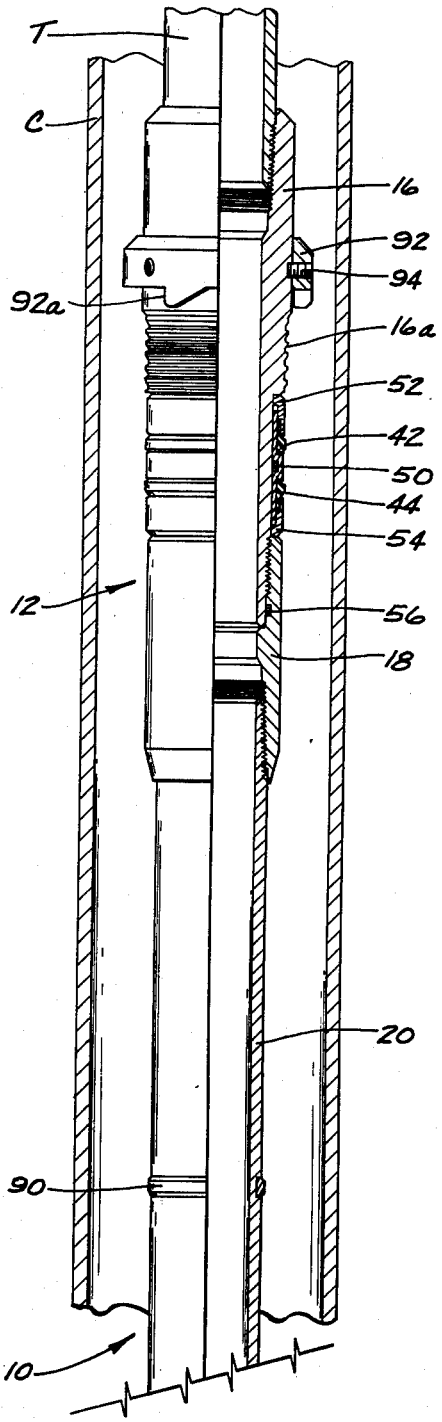
FIGS. 1A and 1B together constitute a view partially in vertical section and partially in elevation illustrating the packer of the present invention in unset condition as it would appear while being lowered into position within a well casing, with FIG. 1A showing the mandrel extending above the packer body, and FIG. 1B showing the components of the packer body.
Figure 1B:
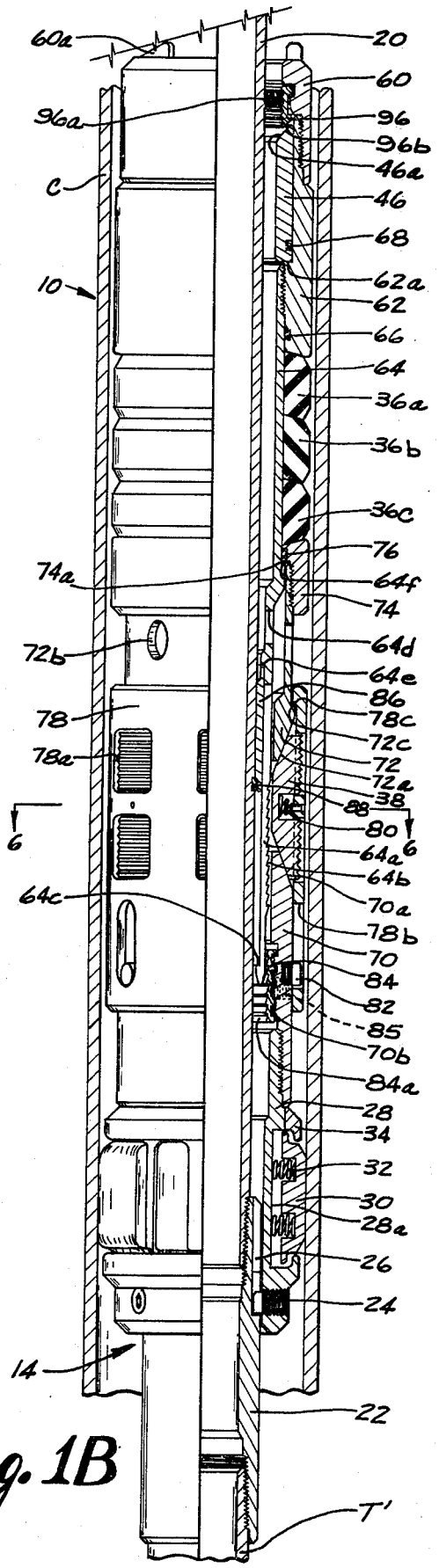

The well packer of the present invention, indicated generally at 10, is illustrated in the drawings within a well casing, or conduit, C. The packer is suspended within the casing C by a tubing string T which is threadedly engaged to the upper end of a mandrel assembly indicated generally at 12. The mandrel assembly 12 extends centrally through the packer body, which is indicated generally at 14. The mandrel assembly 12, which provides a tubular conduit through the packer body 14, includes an upper seal section 16 is threadedly engaged to a lower connector section 18. A tubular mandrel body 20 extends from the lower connector section 18. As shown in FIGS. 1A and 1B, the packer body 14 is connected to the mandrel assembly 12 through the combined operation of a J-slot section 22 threadedly engaged, or otherwise rigidly secured, to the tubular mandrel body 20, and an array of J-slot pins 24 carried at the lower end of the packer body 14. While one such pin and slot combination may suffice, the embodiment of the invention illustrated herein utilizes three pins and three slots, though only two of each are visible. In a conventional manner, each pin 24 extends into one of the J-slots 26 (best seen in FIGS. 2B and 3B) formed in the J-slot 22. Each slot 26 includes a closed vertical leg **26*a* with upper and lower stops 26*b* and 26*c*, respectively, a slanted cam portion 26*d*, a vertical passage 26*e*, and a diverging mouth 26*f*. A continuation of the tubing string T' extends downwardly, as needed, from the J-slot section 22**.

A friction drag assembly 28 employs a plurality of spring loaded friction blocks 30 to hold the packer body 14 in frictional engagement with the internal wall of the casing C for a purpose to be described hereinafter. Each friction block 30 is allowed limited radial movement within an annular bay **28*a* of the friction drag assembly 28, and is urged outwardly by springs 32. A friction block retainer ring 34, welded to the friction drag assembly 28, further defines the top of the bay 28*a* to limit motion by the friction blocks 30**.

Figure 2A:
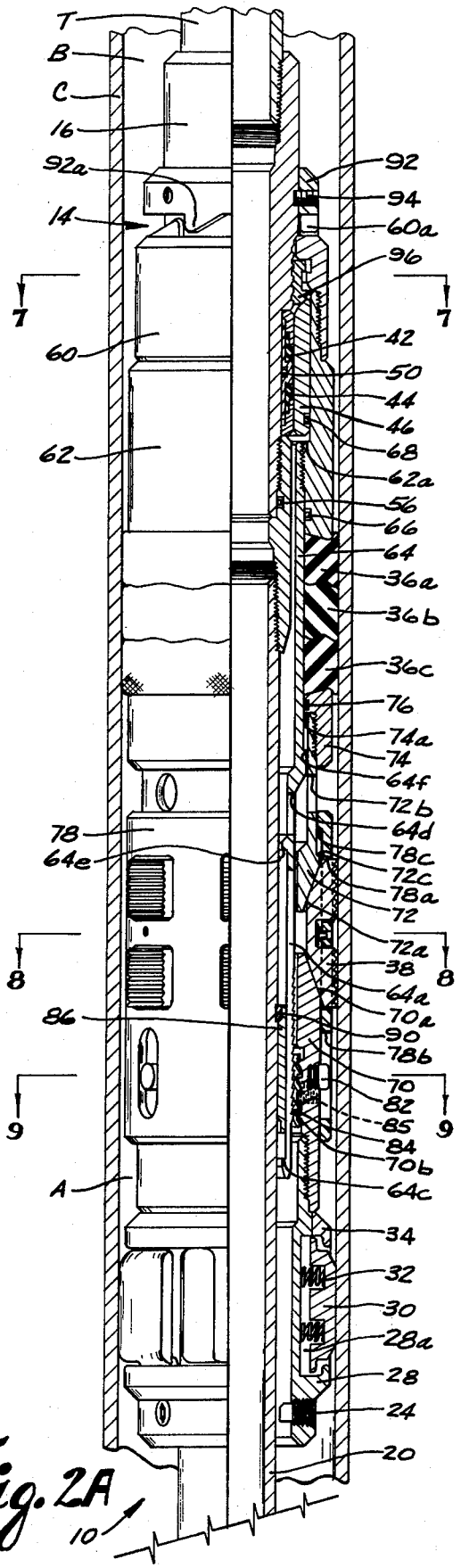
FIGS. 2A and 2B together constitute a view similar to FIGS. 1A and 1B together, illustrating the packer in set condition with the bypass closed, FIG. 2A including the packer body, and FIG. 2B showing the mandrel extending below the packer body.

The packer body 14 includes resilient packer seals **36*a*, 36*b*, and 36*c*, and metal anchoring slip segments 38. When the packer 10 is set, as illustrated in FIG. 2A, the seals 36 function to form a fluid seal with the surrounding casing wall C, and the slip segments 38 are extended radially outwardly into firm gripping engagement with the surrounding casing wall. When the packer 10 is being moved relative to the casing C, the seals 36 and the slip segments 38 are radially retracted away from such engagement with the wall caing, as illustrated in FIG. 1B**.

Figure 3A:
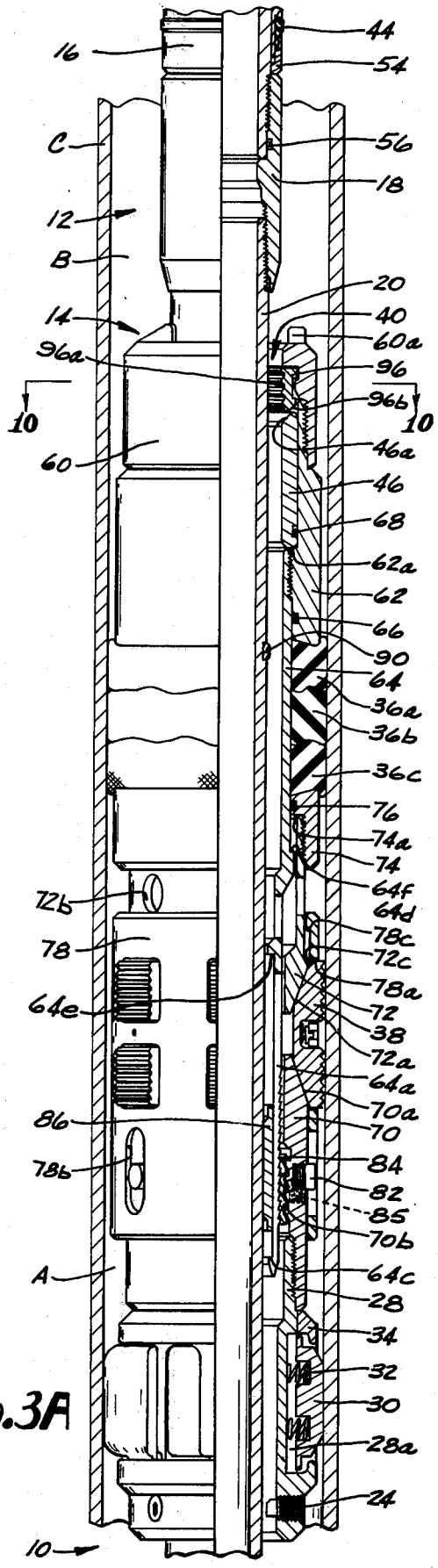
FIGS. 3A and 3B together constitute a view similar to FIGS. 1A, 1B, and 2A, 2B, illustrating the packer in set condition with the bypass opened, FIG. 3A showing the packer body, and FIG. 3B showing the mandrel extending below the packer body.
Figure 4:
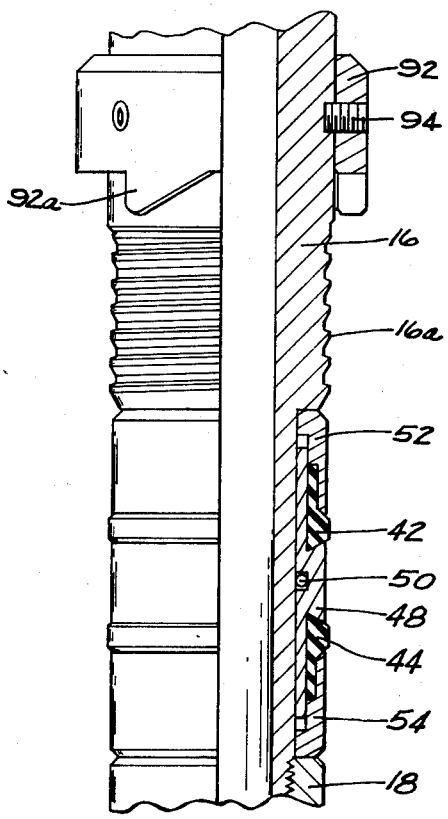
FIG. 4 is an enlarged scale quarter-sectional view of a portion of the mandrel, showing the clutch ring and bypass seals.

FIG. 3A illustrates the packer in set condition, but with the mandrel assembly 12 slightly elevated to open an annular bypass flow passage 40 which extends longitudinally between the mandrel assembly and the packer body 14. The flow passage 40 is closed when the tubing string T and the attached mandrel assembly 12 are lowered into the position illustrated in FIG. 2A. In this latter position, annular seals 42 and 44, carried by the mandrel assembly 12, engage an annular seat member 46 carried by the packer body 14. As may be more fully appreciated by reference to FIGS. 4 and 5, the seals 42 and 44 are mounted on a seal separator member 48, which in turn is fluid-sealed to the upper seal section 16 by an O-ring 50. The upper seal 42 extends under the downwardly facing lip of an upper seal retaining ring 52. Similarly, the lower seal 44 extends under the upwardly facing lip of a lower retaining ring 54. The upper retaining ring 52 cooperates with the seal separator member 48 to secure the upper seal 42 while that seal is able to maintain a sliding seal engagement with the annular seat member 46. Similarly, the lower seal 44 is held by the lower retaining ring 54 in cooperation with the seal separator member 48, and is also able to engage in sliding seal contact with the seat member 46. An O-ring 56 fluid seals the upper seal section 16 to the lower connecting section 18.

The packer 10 is set by moving upper, or first, and lower, or second, components of the packer body 14 toward each other to compress the seals 36 and extend the slip segments 38. The first component includes an annular cap 60, an upper seal retainer 62, and a seal mount assembly 64. These three members 60 through 64 are threaded together in the illustrated manner so that they move as a unit. An O-ring 66 fluid seals the upper seal retainer 62 to the seal mount assembly 64, while another O-ring 68 fluid seals the annular seat member 46 to the upper seal retainer 62. As will be discussed hereinafter, the O-ring 68 rides in an appropriate groove within the outer surface of the annular seat member 46, and provides a sliding seal against the upper seal retainer 62.

The second, or lower, component includes a lower spreader cone 70 and the friction drag assembly 28. These latter two elements 70 and 28 are threaded together to move as a unit also. The lower spreader cone 70 cooperates, to maneuver the slip segments 38, with an upper spreader cone 72, which in turn is connected to a lower seal retainer 74. An O-ring 76 provides a fluid-tight sliding seal between the lower seal retainer 74 and the seal mount assembly 64. The lower spreader cone 70 has an upwardly facing beveled surface **70*a* at its upper end, while the upper spreader cone 72 has a downwardly facing beveled surface 72*a* at its lower end. The upper spreader cone 72 has a radially outward extending annular shoulder 72*c*, and the lower seal retainer 74 features a radially inward extending annular shoulder 74*a***, whose functions are described hereinafter.

Figure 6:
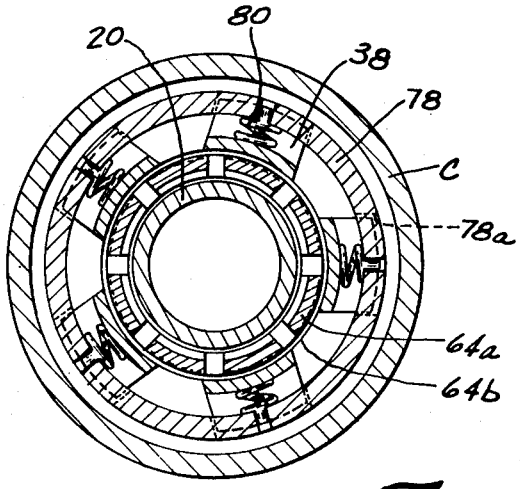
FIG. 6 is an enlarged scale horizontal cross-sectional view taken along the line 6—6 of FIG. 1B.
Figure 8:
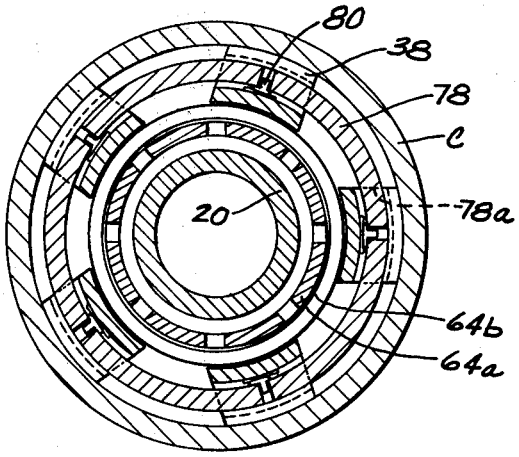
FIG. 8 is an enlarged scale horizontal cross-sectional view taken along line 8—8 of FIG. 2A.

The beveled surfaces **70*a* and 72*a* of the lower and upper spreader cones 70 and 72, respectively, and the anchoring slip segments 38 are disposed within a tubular slip cage 78. The gripping surfaces of the slip segments 38 extend through windows 78*a* in the slip cage 78. Each of the plurality of anchoring slip segments 38 features a pair of beveled surfaces, directed generally radially inwardly to ride on the spreader cone surfaces 70*a* and 72*a*. Springs 80, positioned between the slip cage 78 and the slip segments 38, bias the slip segments toward a radially retracted position out of engagement with the surrounding casing C, as shown in FIG. 6. During the setting operation, the upper and lower spreader cones 72 and 70 are moved toward each other to wedge the slip segments 38 outwardly, overcoming this biasing force, and extending the slip segments into anchoring position, as shown in FIG. 8. Pins 82 extend from the lower spreader cone 70 into slots 78*b* in the slip cage 78 to permit relative longitudinal displacement between the slip cage and the lower spreader cone as required during the setting operation. Similarly, as the two packer components are telescoped to a mating configuration, the seals 36 are compressed between the upper seal retainer 62 of the first packer component and the lower seal retainer 74, which is joined to the upper spreader cone 72, now wedged against the slip segments 38. The slip cage 78 also features a radially inward extending annular shoulder 78*c***, whose function is described hereinafter.

The inner surface of the lower spreader cone 70 is threaded at **70*b*. A split ring locking slip 84 is threaded into place within the lower spreader cone 70. As best seen in FIG. 1B, the inner surface of the locking slip 84 is lined with buttress threads 84*a*, facing downwardly. The split 84*b* in the locking slip 84, visible in FIG. 9, allows the locking slip a degree of flexibility, as discussed in more detail hereinafter. A set screw 85 is threaded in place in an appropriate hole in the lower spreader cone 70, and passes through a hole in the locking slip 84 to prevent further rotation of the locking slip about the threads 70***b*. The seal mount assembly 64 extends downwardly within the tubular slip cage 78 in the form of collet fingers 64*a*. Each collet finger 64*a* is lined on its radially outer surface with buttress thread segments, or wedges, 64*b* facing upwardly. When the packer 10 is being run in the well conduit, or casing, C, the first and second components of the well packer are separated as shown in FIG. 1B. Then, the collet finger wedges 64*b* are displaced longitudinally relative to the buttress threads 84*a* of the locking slip 84. During the setting operation, as the first and second components are telescoped toward each other, the collet fingers 64*a* pass downwardly within the locking slip 84, and the collet finger wedges 64*a* mesh with the buttress threads 84*a* of the locking slip, as illustrated in FIG. 2A. The seal mount assembly 64 is thus connected to the lower spreader cone 70 through the locking slip 84. In this way, the first packer component is mated with the second packer component when the packer is in the set configuration.

The seal mount assembly 64 also features ports 64*d*, a radially inwardly extending annular shoulder 64*e*, and a radially outwardly extending annular shoulder 64*f*, whose functions are described hereinafter.

Figure 9:
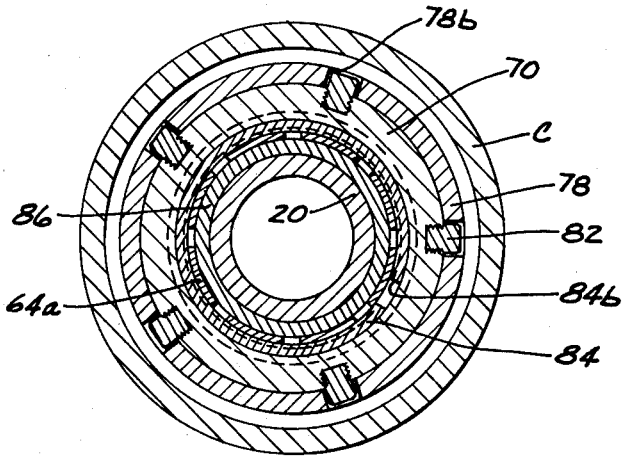
FIG. 9 is an enlarged scale horizontal cross-sectional view taken along line 9—9 of FIG. 2A.

The collet fingers 64*a* are resilient, and may be moved radially. As shown in FIGS. 2A and 9, when the packer 10 is set, a locking sleeve 86 is moved radially inwardly of the collet fingers 64*a* opposite the locking slip 84 to prevent the collet fingers from moving inwardly and to ensure that the collet finger wedges 64*b* are maintained in a firm gripping mesh with the buttress threads 84*a* of the locking slip. Radially inwardly directed shoulders 64*c* at the bottom of the collet fingers 64*a* prevent the locking sleeve 86 from moving downwardly beyond the ends of the collet fingers. As will hereinafter be more fully explained, longitudinal, nonrotative lowering movement of the tubing string T and the attached mandrel assembly 12 moves the locking sleeve 86 under the collet fingers 64*a* and locking slip 84 during the setting procedure. Similar upward movement of the tubing string T and the mandrel assembly 12 removes the locking sleeve 86 from such position, into the position illustrated in FIG. 1B, when the packer 10 is being released from the set position. For this latter purpose, a lower split ring 88 carried on the tubular mandrel body 20 is adapted to engage the lower end of the locking sleeve 86 to pull the sleeve upwardly with upward movement of the mandrel assembly 12 during the releasing and retrieval operation. An upper split ring 90 carried on the tubular mandrel body 20 is adapted to engage the upper end of the locking sleeve 86 during the setting operation to lower the sleeve behind the collet fingers 64*a* and the locking slip 84.

During the setting procedure, the weight of the tubing string T is brought to bear on the upper packer component as the tubing string and the mandrel assembly 12 are lowered relative to the packer body 14. A clutch ring 92 is fixed to the upper seal section 16 of the mandrel assembly 12, and held in place relative thereto by a plurality of set screws 94. The clutch ring 92 is lowered into contact with the annular cap 60 of the upper packer component. At the same time, the friction drag assembly 28 is acting to prevent downward longitudinal movement of the lower packer component relative to the well casing C. In this way, the weight of the tubing string T is employed to mate the upper and lower packer components by engagement of the collet finger wedges 64*b* with the buttress threads 84*a* of the locking slip 84. When this mating configuration is achieved, the slip segments 38 and the seals 36 are extended into engagement with the casing C. With the packer 10 thus initially set, additional force is generated to enhance the engagement of the seals 36 and the slip members 38 with the wall of the well casing C. Downwardly extending teeth 92*a* on the bottom of the clutch ring 92 mesh with an equal number of upwardly extending teeth 60*a* at the top of the annular cap 60. Although one such pair of teeth 92*a* and 60*a* will serve the purpose, the embodiment illustrated herein employs three such teeth pairs, with only two visible in the drawings. The vertical faces of meshed tooth pairs 92*a* and 60*a* are oriented for transmission of torque in a right-hand rotational sense as illustrated. Once the upper and lower packer components are mated as described hereinbefore, application of torque to the tubing string T at the well surface causes rotation of the mandrel assembly 12 in a right-hand sense, with consequent rotation of the annular cap 60. The three elements 60, 62, and 64, comprising the first packer component then rotate as a unit relative to the second packer component which is held, by the friction drag assembly 28, rotationally fixed relative to the well casing C. The relative rotational motion between the two packer components results in the collet finger wedges 64*b* advancing downwardly relative to the buttress threads 84*a* of the locking slip 84. Such threading movement of the collet fingers 64*a* relative to the locking slip 84 results in continued mutual telescoping motion of the first and second packer components. Thus, as the tubing string T is used to rotate the first packer component relative to the second packer component through the torque-transmitting connection between the clutch ring 92 and the annular cap 60, the upper and lower cone spreaders 72 and 70 further drive the slip segments 38 against the wall of the well casing C, and the upper and lower seal retainers 62 and 74 further longitudinally compress the seals 36, causing the seals to be further pressed against the wall of the casing. In this way, the packer 10 can be set with the slip segments 38 and the seals 36 pressed against the well conduit C with forces that might be obtained in a well set packer according to the prior art only where a tubing string T of extreme length is available to bring sufficient weight to bear against the packer. Once the packer 10 is thus set through rotational motion of the upper packer component relative to the lower packer component, the set condition of the packer may be maintained regardless of limited lontigudinal movement of the mandrel assembly 12 and tubing string T relative to the packer body 14, since the set condition of the packer is dependent upon the mating of the first and second packer components rather than the weight of the tubing string.

When the secondary flow passage, or bypass, 40 through the set packer 10 is open, as illustrated in FIG. 3A, fluids in the annular region between the mandrel assembly 12 and the well casing C may flow into or out of the bypass 40 through the ports 64*d*, which extend through the seal mount assembly 64, and ports 72*b* which extend through the upper cone spreader 72. When the tubing string T and the mandrel assembly 12 are lowered into the position illustrated in FIGS. 2A and 5 the annular seals 42 and 44 engage the annular seat member 46 to close the bypass opening 40, as described hereinbefore. Then, O-rings 50, 56, 68, 66, and 76 cooperate with the annular seals 42 and 44 as well as the seals 36 to provide fluid tight sealing between the mandrel assembly 12 and the well casing C. Under normal producing conditions, the pressure existing in the closed bypass 40 and the annulus area A below the set seals 36 is greater than the pressure existing in the annulus area B above the packer 10. Under these circumstances, a pressure differential exists across the seals 42 and 44 which exerts an upward lifting force on the tubing string T and the attached mandrel assembly 12. To prevent this lifting force from opening the bypass 40, a pressure-responsive compensating system is employed to increase the forces maintaining the tubing string T and mandrel assembly 12 in position to close the bypass 40.

The pressure compensating system includes a snap lock, or split ring, 96 held in an annular groove 60*b* within the inner surface of the annular cap 60 as shown. Details of the snap lock 96, and the pressure compensating system in general may be more fully appreciated by reference to FIGS. 5, 7 and 10. The radially inner surface of the snap lock 96 features buttress-like threads 96*a*, facing downwardly, which are adapted to mesh with corresponding threads 16*a*, facing upwardly, on the upper seal section 16 just below the location of the clutch ring 92. The snap lock 96 is sufficiently resilient so that the threads 96*a* and 16*a* will mutually engage or disengage by longitudinal movement of the mandrel assembly 12 relative to the snap lock 96 when no forces are applied to drive the snap lock radially inwardly against the upper seal section 16. The snap lock 96 features a beveled lower surface 96*b* which is positioned to contact an oppositely facing beveled upper surface 46*a* on the annular seal member 46. The seal member 46 constitutes an annular piston whose longitudinal movement within the packer body 14 is limited in the upper direction by the beveled surface 96*b* of the snap lock 96, and in the downward direction by an annular, inwardly directed shoulder 62*a* of the upper seal retainer 62.

Figure 5:
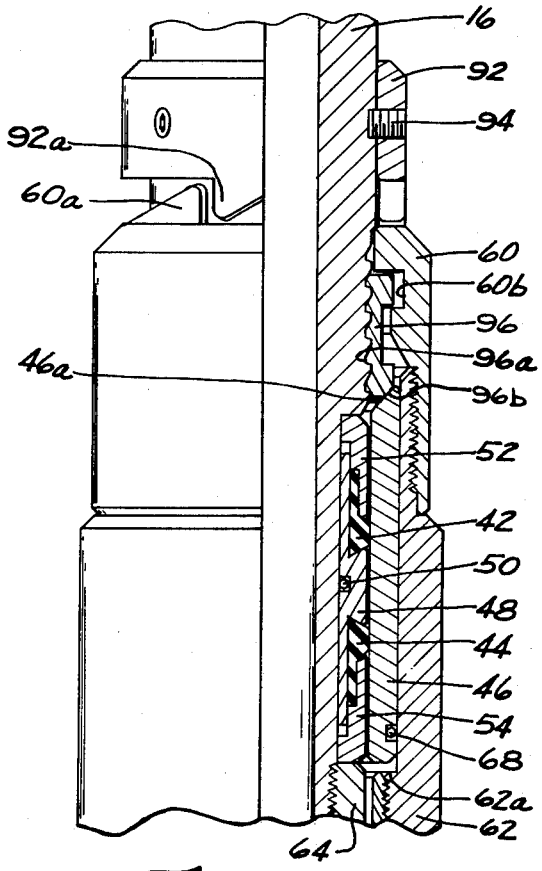
FIG. 5 is an enlarged scale quarter-sectional view of the mandrel portion shown in FIG. 4, engaged with the first packer component.
Figure 7:
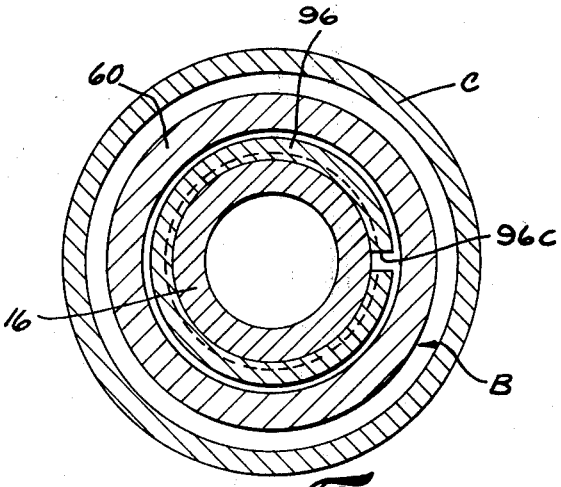
FIG. 7 is an enlarged scale horizontal cross-sectional view taken along the line 7—7 of FIG. 2A.
Figure 10:
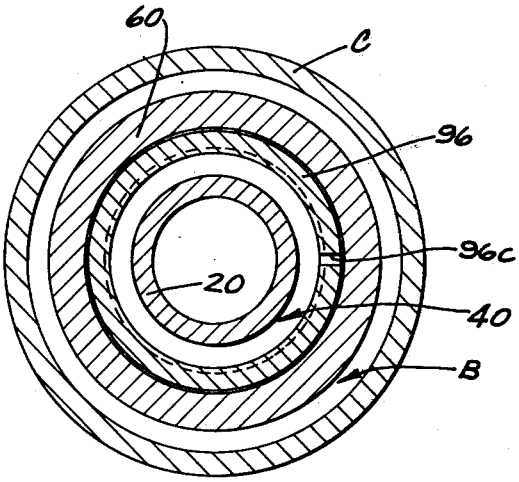
FIG. 10 is an enlarged scale horizontal cross-sectional view taken along line 10—10 of FIG. 3A.

When the packer 10 is set, and the bypass flow passage 40 is closed as illustrated in FIGS. 2A, 5 and 7, pressure from below the seals 36 generates upwardly-directed forces on the mandrel assembly 12 and the tubing string T, as well as the seat member 46, over an annular area extending from the O-ring 56 outwardly to the O-ring 68. This upwardly directed force drives the annular seat member 46 against the snap lock 96. The oppositely facing surfaces 96*b* and 46*a* are cut at essentially 45° angles relative to the longitudinal axis of the packer body 14. Consequently, the upwardly directed forces transmitted by the annular seat member 46, being applied to the beveled surface 96*b* of the snap lock 96, are transmitted to the snap lock with components directed radially inwardly. These component forces along radial lines urge the snap lock radially inwardly against the upper seal section 16, thereby increasing the forces by which the mandrel assembly 12 and the tubing string T are fixed against longitudinal movement relative to the set packer and the well casing C. As seen in FIG. 7, the snap lock 96 is split at 96*c*, allowing a degree of flexibility for the snap lock to close more tightly on the mandrel assembly 16. FIG. 10 shows the snap lock 96 in expanded state, disengaged from the upper seal section 16. Thus, as the pressure in the annular region A increases compared to that in the annular region B, the forces restraining the tubing string T and the mandrel assembly 12 from moving out of the position illustrated in FIG. 2A, in which the secondary flow passage 40 is closed, increase to offset the upward pressure urging the tubing string upwardly.

In a situation in which the pressure differential across the set seals 36 is such that the pressure in the annular region B is greater than that in the region A, the net pressure difference also generates forces in the annular region extending from the O-ring 56 outwardly to the O-ring 68. Then, downwardly directed forces act on the annular seat member 46 to drive this element against the shoulder 62*a* of the upper seal retainer 62. The pressure in the annular region B also urges the tubing string T and the mandrel assembly 12 downwardly, causing the split ring 96 to be pressed against the top of the annular seat member 46. Interaction of the contacting beveled surfaces 96*b* and 46*a* results in forces acting on the snap lock 96, driving the snap lock against the mandrel assembly 12, as well as forces acting on the upper portion of the annular seat member 46, tending to urge this element radially outwardly against the upper seal retainer 62. Consequently, as the pressure in the annular region B above the set seals 36 increases over the pressure in the lower annular region A, the forces tending to hold the mandrel assembly 12, and, therefore, the tubing string T, fixed longitudinally relative to the set packer 10 are increased also.

PLACING AND SETTING THE PACKER

The packer 10, connected to the tubing string T through the pins 24, is lowered into the well casing C with the packer elements in the relative positions illustrated in FIGS. 1A and 1B. In this running-in configuration, the friction blocks 30 slide along the internal surface of the casing C, resisting the sliding motion. The frictional forces exerted by the drag assembly 28 may be overcome by the weight of the tubing string T exerted against the pins 24 through the upper stops 26*b* of the J-slots 26.

When the desired subsurface location has been reached, the downward motion of the tubing string T is stopped and the tubing string is raised slightly until the pins 24 are engaged by the lower stops 26*c* of the respective J-slots 26. During this raising movement, the packer body 14 is held stationary within the casing C by the action of the friction drag assembly 28. With the pins 24 at the lower stops 26*c*, the tubing string T is slightly rotated, causing the pins to ride up the slanted cam portions 26*d* along the bottoms of the vertical passages of 26*e* of the J-slots 26, so that subsequent lowering of the tubing string T causes the pins to move into the vertical passages. In this position, the tubing string T may be further lowered to clear the pins 24 out of the diverging slot mouths 26*f* and to continue the setting operation.

Continued lowering of the tubing string T permits the lower end of the clutch ring 92 to engage the top surface of the annular cap 60. As these two elements approach each other, the threads 16*a* on the outer surface of the upper seal section 16 ratchet into meshing engagement with the buttress threads 96*a* lining the interior surface of the snap lock 96. At the same time, the teeth 92*a* of the clutch ring 92 mesh with the teeth 60 *a* of the annular cap 60. Subsequent lowering of the tubing string T exerts a downwardly directed force against the upper, or first, packer component, which causes the seal mount assembly 64 to telescope downwardly through the lower, or second, packer component which is held stationary by the friction drag assembly 28. This telescoping action causes the collet fingers 64*a* to move downwardly relative to the locking slip 84 and the lower spreader cone 70. During the initial phase of the setting movement, the upper seal retainer 62 is forced downwardly against the seals 36, which in turn urge the lower seal retainer 74 downwardly against the upper cone spreader 72. As this motion takes place, the lower spreader cone 70 is held fixed relative to the well casing C by the friction drag assembly 28. As a result, the slip segments 38 are urged downwardly over the lower spreader cone beveled surface 70*a* as the beveled surface 72*a* of the upper spreader cone 72 is wedged down behind the slip segments. The slip segments 38 are thus caused to move outwardly as they advance downwardly along the lower spreader cone 70. Once the slip segments 38 grip the casing C, very large downwardly directed forces may be exerted against the packer body 14 without displacing the packer. Continued lowering of the upper packer component further compresses the seals 36 into engagement with the well casing C.

As the mandrel assembly 12 is lowered during this setting operation, the upper split ring 90 engages the upper end of the locking sleeve 86, causing the sleeve to move downwardly from the position illustrated in FIG. 1B to the position illustrated in FIG. 2A. In this latter position, the locking sleeve 86 holds the collet fingers 64*a* rigidly against the locking slip 84. Because of this function, the locking sleeve 86 in the position shown in FIG. 2A acts as a blocking means to block unlocking movement of the collet fingers 64*a* relative to the locking slip 84.

With the upper and lower packer components mated, and the packer initially set as described, the connection between the upper and lower packer components may be tightened by rotation of the tubing string T. Such rotation results in torque applied to the upper packer component through the meshed teeth 92*a* of the clutch ring 92 and 60*a* of the annular cap 60. As the upper packer component is thus rotated in a right-hand sense relative to the well casing C, the lower packer component is held rotationally fixed to the well casing by the friction drag assembly 28. As such relative rotational motion is carried out, the collet fingers 64*a* rotate relative to the locking slip 84, thereby causing the collet finger wedges 64*b* to advance along the helical buttress threads 84*a* lining the interior surface of the locking slip. Thus, the locking slip 84 is urged upwardly as the collet fingers 64*a* are drawn downwardly. The resulting effect is that the upper and lower packer components are further telescoped together, increasing the forces which wedge the slip segments 38 radially outwardly against the well casing C as well as the forces which press the seals 36 against the well casing in fluid-seal engagement.

Figure 2B:
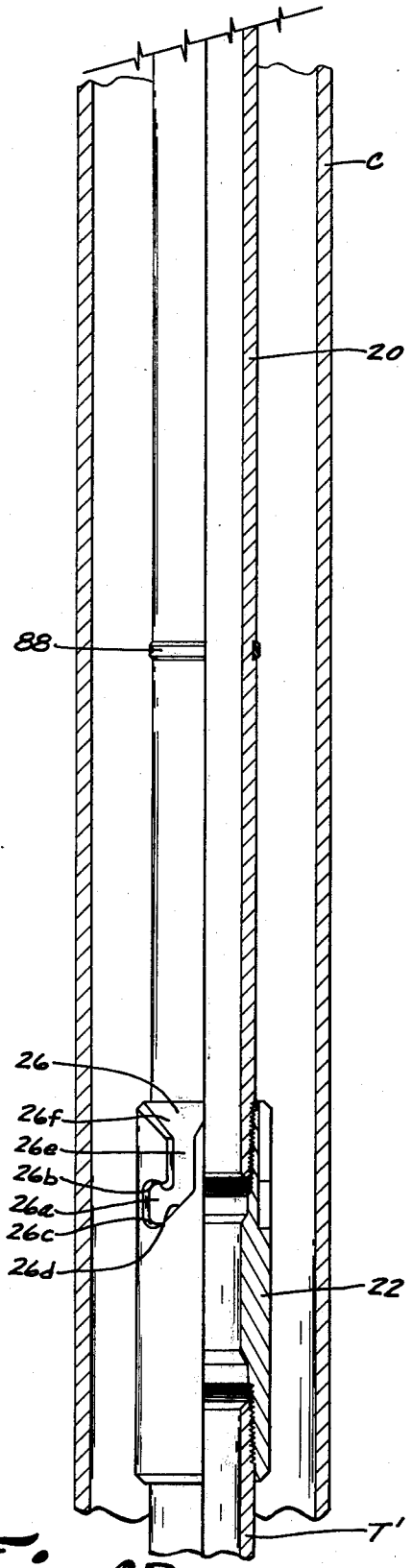
Figure 3B:
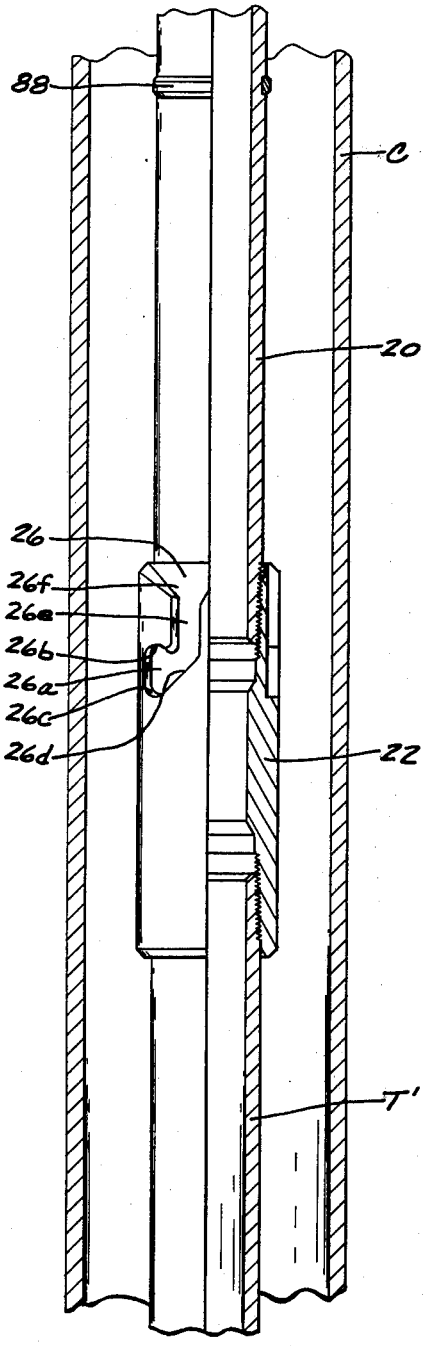

With the packer 10 thus tightened in its set configuration, as illustrated in FIGS. 2A and 2B, the well packer is firmly anchored against well pressures acting against the packer in either direction. Thus, if the pressure in the lower annular area A is greater than that in the upper annular area B, a net upwardly directed force is exerted against the packer seals 36. This force is imparted to the upper packer component which in turn acts through the collet fingers 64*a* and the locking slip 84 to cause the lower spreader cone 70 to exert additional force against the slip segments 38, which in turn increases the anchoring force by which the packer is held fixed to the well casing C. This force increases as the pressure differential increases. If the pressure above the packer in the annular area B is greater than that in the annular area A below the packer, a net downwardly directed force is exerted on the packer seals 36. This force acts against the lower seal retainer 74, which is rigidly connected to the upper spreader cone 72. Thus, increased downward forces on the seals 36 further urge the upper spreader cone 72 downwardly against the slip segments 38, so that once again the slip segments exert increasing anchoring forces against the well casing C as the pressure induced forces acting on the packer 10 increase.

The same pressure differentials which act across the packer seals 36 also act across the bypass seals 42 and 44 when the bypass 40 is closed. With a higher pressure below the seals 42 and 44, the pressure differential tends to raise the mandrel assembly 12 to unseat the bypass seals. As discussed in detail hereinbefore, increased gripping forces tending to hold the upper seal section 16 in position are generated by that same pressure differential through the mechanism of the snap lock 96 and the annular seat member 46. Compensation for the increased lower pressure is accomplished by the interaction of the beveled annular faces 96*b* and 46*a* of the snap lock 96 and the annular seat member 46, respectively. The result is that the snap lock 96 is wedged with greater force against the mandrel assembly 12, with the inner surface threads 96*a* of the snap lock meshed with the threads 16*a* of the upper seal section 16. With the snap lock 96 thus held fixed to the mandrel assembly 12, the combination of these two elements are in turn held against upward longitudinal movement by the annular cap 60 of the set packer body 14.

If a reversal of the direction of the pressure differential occurs, such that the pressure above the set packer body 14 is higher than that below the packer body, the mandrel assembly 12 is urged downwardly within the packer body. Downward movement of the mandrel assembly 12 and the attached tubing string T is limited by the clutch ring 92 contacting the top of the annular cap 60 of the set packer body 14 as shown in FIG. 2A. Thus, while pressure acting on the seals 42 and 44 urges the mandrel assembly 12 downwardly against the set packer body 14, the seals 42 and 44 maintain sealing engagement with the annular seat member 46 to keep the bypass 40 closed.

OPENING AND CLOSING THE BYPASS

The secondary bypass flow passage 40 may be opened by lifting the tubing string T to remove the annular seals 42 and 44 from sealing engagement with the annular seat member 46, as shown in FIG. 3A. With the packer body 14 in set configuration, the snap lock 96, held against upward motion by the annular cap 60, is forced to expand by the upward movement of the upper seal section 16. Thus, the threads 16*a* on the upper seal section 16 ratchet out of engagement with the snap lock threads 96*a*, thereby freeing the mandrel assembly 12 from the packer body 14 without the need to rotate the tubing string T or the upper packer components. Similarly, the upper seal section 16 ratchets down into anchoring engagement with the snap lock 96, and sealing engagement with the seat member 46, as shown in FIGS. 2A and 5, with the packer body 14 tightened in set configuration by mere downward movement of the tubing string T. The tubing string T and the attached mandrel assembly 12 may be thus elevated to open the bypass 40, without disturbing the set condition of the packer body 14, to the point that the lower split ring 88 first engages the lower end of the locking sleeve 86. Since the upper and lower components of the packer body 14 are mated together through the locking slip 84 and the collet fingers 64*a*, the packer body 14 remains in set condition while the mandrel assembly 12 is elevated to open the bypass 40. As a result, well fluids may be circulated downwardly through the tubing string T, the mandrel assembly 12, and the tubing string continuation T', and up through the annular region A and the flow passage 40 at a rapid rate without concern for either unsetting or moving the packer.

Since the packer 10 remains set independently of the presence or absence of the weight of the tubing string T on the packer body 14, only enough tubing string weight need be set on the packer to close the bypass 40 so that the annular sliding seals 42 and 44 make sufficient contact with the annular seat member 46 to insure a fluid tight sealing closure of the bypass 40. This permits a very large portion of the tubing string weight to be carried by the well head so that the tubing string T can be stretched out to assume as linear a configuration as possible. This in turn facilitates wireline operations and similar servicing which must be performed through the tubing string T. Moreover, additional latitude in the design and construction of the packer 10 is permitted since the packer need not withstand the usual tubing string weight load required in maintaining some prior art weight set packers anchored during production.

RELEASING AND RETRIEVING THE PACKER

The packer 10 is released from its set position and retrieved to the surface, or repositioned for subsequent resetting in the casing C, by raising the tubing string T. This action draws the lower split ring 88 upwardly against the locking sleeve 86, and slides the locking sleeve upwardly within the collet fingers 64*a* out of locking position, as shown in FIGS. 2A and 3A, to the position illustrated in FIG. 1B. With the locking sleeve 86 thus positioned, the collet fingers 64*a* are free to bend radially inwardly permitting the collet finger wedges 64*b* to be raised and ratchet out of intermeshed gripping engagement with locking slip buttress threads 84*a* in much the same way the upper seal section 16 ratchets out of engagement with the snap lock 96. The lifting force of the mandrel assembly 12 is transmitted though the split ring 88 and the locking sleeve 86 to the seal mount assembly 64 as the locking sleeve contacts the radially inward annular shoulder 64*e* of the seal mount assembly. The seal mount assembly 64 in turn transmits the lifting force to the upper spreader cone 72 by interaction of the radially outward shoulder 64*f* of the seal mount assembly and the radially inward shoulder 74*a* of the lower seal retainer 74, which is rigidly connected to the upper cone spreader. Thus, the entire upper packer component is raised, drawing the upper spreader cone 72 away from the slip segments 38. Continued upward lifting causes the upper spreader cone 72 to raise the slip cage 78 by interaction of the radially outward shoulder 72*c* with the radially inward shoulder 78*c* of the slip cage assembly. Upward movement of the slip cage assembly 78 pushes the anchoring slip segments 38 off of the lower spreader cone 70. This action allows the upper and lower components of the packer body 14 to return to their original, unmated positions, permitting the packer seals 36*a*, 36*b*, and 36*c* and the anchoring slip segments 38 to return to their retracted, unset positions.

Following retraction of the packer slip segments 38 and the seals 36, subsequent upward movement of the tubing string T draws the J-slot section 22 into engagement with the pins 24, each pin entering the diverging mouth 26*f* of a J-slot 26. As the tubing string T is further raised, the pins 24 align with the vertical passages 26*e*, and eventually the slanted cam portions 26*d* are drawn into engagement with the pins. Subsequent raising seats the pins 24 against the lower stops 26*c*, and the friction drag assembly 28 and the attached packer body 14 are lifted upwardly with the tubing string T.

It will be appreciated that the configuration of the packer 10, upon release from set configuration, is essentially the same as the configuration for running the packer in the well before setting. Thus, as seen in FIGS. 1A and 1B, weight of the packer body 14 is supported by the tubing string T through the mandrel assembly 12, the tubular mandrel body 20, the lower split ring 88, the locking sleeve 86, and the seal mount assembly 64. The seal mount assembly 64 supports the upper packer component directly, and the lower packer component through the lower seal retainer 74, the upper cone spreader 72, and the slip cage 78.

The packer 10 may be moved to a lower position within the well casing C by merely lowering the tubing string T. The previously described setting procedure may be repeated to anchor the packer 10 at any loction in the well without need for retrieving the packer to the well surface.

From the foregoing description, it will be appreciated that: (a) the packer of the present invention may be both set and released by longitudinal movement of the tubing string or other member from which it is suspended; (b) the packer may be tightened in the set configuration by rotational motion of the tubing string without need for additional weight or hydraulic pressure; (c) a bypass passage in the packer may be opened and closed by longitudinal, non-rotative movement of the tubing string while the packer remains firmly anchored in set configuration; (d) mechanical anchoring means automatically function to retain the packer firmly set against a high pressure acting on the packer from either above or below; and (e) pressure compensation means prevent the bypass passage from opening in response to pressure differentials across the packer, whether the higher pressure occurs above or below the bypass closure sealing mechanism.

The packer of the present invention has been described in its preferred embodiment, but various changes in the construction and operation of the packer may be made without departing from the spirit of the invention. Thus, by way of example rather than limitation, by appropriate reversal of parts, the packer may be set by exerting tension on the tubing string.

The foregoing disclosure and description of the invention is illustrative and explanatory thereof, and various changes in the method steps as well as in the details of the illustrated apparatus may be made within the scope of the appended claims without departing from the spirit of the invention.

We claim:

1. Apparatus for use in a conduit comprising:

a. sealing means for selectively sealing said apparatus to said conduit by sealing engagement with said conduit;

b. body means including a first component and a second component, and carrying said sealing means, such that said apparatus may be selectively set, with said sealing means in said sealing engagement with said conduit, by non-rotative first phase motion of said first and second components toward each other;

c. mandrel means passing generally through said body means and selectively moveable relative thereto; and d. tightening means for selectively increasing forces maintaining said sealing means in sealing engagement with said conduit, when said apparatus is set, operable by second phase motion of said first and second components toward each other effected by relative rotational motion between said first and second components.

2. Apparatus as defined in claim 1 wherein said tightening means comprises thread means, connecting said first and second components when said apparatus is set, and by which said relative rotational motion between said first and second components effects said second phase motion of said first and second components toward each other.

3. Apparatus as defined in claim 2 wherein said tightening means further comprises clutch means for imparting torque to produce said relative rotational motion between said first and second components.

4. Apparatus as defined in claim 2 wherein said mandrel means is connectible to said body means by said clutch means for imparting said torque to produce said relative rotational motion between said first and second components to effect said second phase motion of said first and second components toward each other.

5. Apparatus as defined in claim 4 wherein said first phase motion of said first and second components toward each other is effected by longitudinal motion of said mandrel means relative to said conduit.

6. Apparatus as defined in claim 5 further comprising anchoring means for selectively anchoring said apparatus to said conduit by anchoring engagement with said conduit.

7. Apparatus as defined in claim 6 wherein said anchoring means anchors said apparatus to said conduit by said anchoring engagement when said apparatus is set by said first phase motion of said first and second components toward each other, and wherein the forces maintaining said anchoring means in said anchoring engagement with said conduit are increased by said second phase motion of said first and second components toward each other.

8. Apparatus as defined in claim 7 further comprising locking means for selectively, releasably preventing relative motion of said first and second components away from each other when said apparatus is set, with said sealing means and said anchoring means in sealing and anchoring engagement with said conduit, respectively.

9. Apparatus as defined in claim 8 further comprising release means for releasing said locking means from preventing said relative motion of said first and second components away from each other.

10. Apparatus as defined in claim 9 further comprising:

a. bypass passage means for fluid flow along said conduit by said sealing means when said sealing means is in sealing engagement with said conduit; and b. bypass control means, for selectively opening and closing said bypass passage means, including bypass seal means and seat means, whereby said bypass passage means is closed to said fluid flow therethrough when said bypass seal means is in sealing engagement with said seat means, and whereby said bypass passage means is open to said fluid flow therethrough when said bypass seal means is not in sealing engagement with said seat means.

11. Apparatus as defined in claim 10 wherein said bypass control means is operated to so selectively open and close said bypass passage means by longitudinal movement of said mandrel means relative to said body means.

12. Apparatus as defined in claim 11 further comprising compensation means, responsive to pressure differentials across said sealing means and said bypass seal means, when said sealing means is in sealing engagement with said conduit and when said bypass seal means is in sealing engagement with said seat means, to maintain said bypass seal means in sealing engagement with said seat means to kep said bypass passage means closed to fluid flow therethrough with force which increases as said pressure differentials increase.

13. Apparatus as defined in claim 12 wherein said compensation means comprises:

a. snap lock means, carried by said body means, connectible to said mandrel means for maintaining said mandrel means fixed against longitudinal movement relative to said body means; and b. piston means for acting in combination with said snap lock means, when said snap lock means is connected to said mandrel means, in response to said pressure differentials to increase the forces by which said snap lock means is connected to said mandrel means to maintain said mandrel means fixed against longitudinal movement relative to said body means.

14. Apparatus as defined in claim 7 further comprising:

a. bypass passage means for fluid flow along said conduit by said sealing means when said sealing means is in sealing engagement with said conduit; and b. bypass control means, for selectively opening and closing said bypass passage means, including bypass seal means and seat means, whereby said bypass passage means is closed to said fluid flow therethrough when said bypass seal means is in sealing engagement with said seat means, and whereby said bypass passage means is open to said fluid flow therethrough when said bypass seal means is not in sealing engagement with said seat means.

15. Apparatus as defined in claim 14 wherein said bypass control means is operated to so selectively open and close said bypass passage means by longitudinal movement of said mandrel means relative to said body means.

16. Apparatus as defined in claim 15 further comprising compensation means, responsive to pressure differentials across said sealing means and said bypass seal means, when said sealing means is in sealing engagement with said conduit and when said bypass seal means is in sealing engagement with said seat means, to maintain said bypass seal means in sealig engagement with said seat means to keep said bypass passage means closed to fluid flow therethrough with force which increases as said pressure differentials increase.

17. Apparatus as defined in claim 4 further comprising flow passage means extending through said apparatus for conducting fluids through said sealing means.

18. Apparatus as defined in claim 17 further comprising:

a. bypass passage means for fluid flow along said conduit by said sealing means when said sealing means is in sealing engagement with said conduit; and b. bypass control means, for selectively opening and closing said bypass passage means, including bypass seal means and seat means, whereby said bypass passage means is closed to said fluid flow therethrough when said bypass seal means is in sealing engagement with said seat means, and whereby said bypass passage means is open to said fluid flow therethrough when said bypass seal means is not in sealing engagement with said seat means.

19. Apparatus as defined in claim 18 further comprising compensation means, responsive to pressure differentials across said sealing means and said bypass seal means, when said sealing means is in sealing engagement with said conduit and when said bypass seal means is in sealing engagement with said seat means, to maintain said bypass seal means in sealing engagement with said seat means to keep said bypass passage means closed to fluid flow therethrough with force which increases as said pressure differentials increase.

20. Apparatus as defined in claim 1 wherein said mandrel means is engageable with said body means to produce said first phase motion of said first and second components toward each other by longitudinal motion of said mandrel means relative to said conduit, and engageable to said body means to produce said relative rotational motion between said first and second components to effect said second phase motion of said first and second components toward each other.

21. Apparatus as defined in claim 20 further comprising locking means for selectively, releaseably preventing relative motion of said first and second components away from each other when said apparatus is set with said sealing means in sealing engagement with said conduit.

22. Apparatus as defined in claim 21 further comprising release means for releasing said locking means from preventing said relative motion of said first and second components away from each other.

23. Apparatus as defined in claim 22 further comprising:

a. bypass passage means for fluid flow along said conduit by said sealing means when said sealing means is in sealing engagement with said conduit; and b. bypass control means, for selectively opening and closing said bypass passage means, including bypass seal means and seat means, whereby said bypass passage means is closed to said fluid flow therethrough when said bypass seal means is in sealing engagement with said seat means, and whereby said bypass passage means is open to said fluid flow therethrough when said bypass seal means is not in sealing engagement with said seat means.

24. Apparatus as defined in claim 23 wherein said bypass control means is operated to so selectively open and close said bypass passage means by longitudinal movement of said mandrel means relative to said body means.

25. Apparatus as defined in claim 24 further comprising compensation means, responsive to pressure differentials across said sealing means and said bypass seal means, when said sealing means is in sealing engagement with said conduit and when said bypass seal means is in sealing engagement with said seat means, to maintain said bypass seal means in sealing engagement with said seat means to keep said bypass passage means closed to fluid flow therethrough with force which increases as said pressure differentials increase.

26. Apparatus as defined in claim 25 wherein said compensation means comprises:

a. snap lock means, carried by said body means, connectible to said mandrel means for maintaining said mandrel means fixed against longitudinal movement relative to said body means; and b. piston means for acting in combination with said snap lock means, when said snap lock means is connected to said mandrel means, in response to said pressure differentials to increase the forces by which said snap lock means is connected to said mandrel means to maintain said mandrel means fixed against longitudinal movement relative to said body means.

27. Apparatus as defined in claim 20 further comprising anchoring means for selectively anchoring said apparatus to said conduit by anchoring engagement with said conduit.

28. Apparatus as defined in claim 27 wherein said anchoring means anchors said apparatus to said conduit by said anchoring engagement when said apparatus is set by said first phase motion of said first and second components toward each other, and wherein the forces maintaining said anchoring means in said anchoring engagement with said conduit are increased by said second phase motion of said first and second components toward each other.

29. Apparatus as defined in claim 20 further comprising flow passage means extending through said apparatus for conducting fluids through said sealing means.

30. Apparatus as defined in claim 1 further comprising flow passage means extending through said apparatus for conducting fluids through said sealing means.

31. Apparatus as defined in claim 30 further comprising:

a. bypass passage means for fluid flow along said conduit by said sealing means when said sealing means is in sealing engagement with said conduit; and b. bypass control means, for selectively opening and closing said bypass passage means, including bypass seal means and seat means, whereby said bypass passage means is closed to said fluid flow therethrough when said bypass seal means is in sealing engagement with said seat means, and whereby said bypass passage means is open to said fluid flow therethrough when said bypass seal means is not in sealing engagement with said seat means.

32. Apparatus as defined in claim 31 further comprising compensation means, responsive to pressure differentials across said sealing means and said bypass seal means, when said sealing means is in sealing engagement with said conduit and when said bypass seal means is in sealing engagement with said seat means, to maintain said bypass seal means in sealing engagement with said seat means to keep said bypass passage means closed to fluid flow therethrough with force which increases as said pressure differentials increase.

33. Apparatus as defined in claim 1 wherein said first phase motion of said first and second components toward each other is effected by pushing one such component toward the other.

34. Well packer apparatus for use in a well conduit comprising:

a. a mandrel connectible to a tubing string;

b. a packer body, supportable by said mandrel, and including a first component and a second component;

c. packer sealing means extendable between sealing and non-sealing engagement with said well conduit for selectively preventing or permitting fluid flow through said well conduit;

d. anchoring means extendable between anchoring and non-anchoring engagement with said well conduit for selectively anchoring said packer apparatus to said well conduit or releasing said packer apparatus for movement relative to said well conduit;

e. setting means operable by longitudinal movement of said tubing string for moving said first and second components toward each other for setting said packer apparatus whereby said packer sealing means and said anchoring means are extended into sealing and anchoring engagement, respectively, with said well conduit;

f. tightening means, selectively operable by rotation of tubing string connected to said mandrel, for increasing the forces by which said packer sealing means and said anchoring means engage said well conduit in said set condition;

g. primary flow passage means extending through said well packer apparatus for conducting fluids through said sealing means;

h. secondary flow passage means extending through said well packer apparatus selectively operable between an open configuration for bypassing fluids through said well packer apparatus while said packer sealing means is in sealing engagement with said well conduit and a closed configuration preventing fluid bypass through said secondary flow passage means; and i. compensation means responsive to pressure differentials across said packer sealing means, when said packer sealing means is in sealing engagement with said well conduit and said secondary flow passage means is in said closed configuration, to maintain said secondary flow passage means in said closed configuration with force which increases as said pressure differentials increase.

35. Well packer apparatus as defined in claim 34 wherein said tightening means operates to increase the forces by which said packer sealing means and said anchoring means engage said well conduit in said set condition by further moving said first and second components toward each other.

36. Well packer apparatus as defined in claim 35 further comprising:

a. thread means, connecting said first and second components when said well packer apparatus is set; and b. clutch means, as part of said tightening means, by which rotational motion is transmitted to said well packer apparatus from said tubing string to produce relative rotational motion between said first and second components to so further move said first and second components toward each other to increase the forces by which said packer sealing means and said anchoring means engage said well conduit in said set condition.

37. Well packer apparatus as defined in claim 36 further comprising release means whereby said well packer apparatus may be released from said set condition, with said packer sealing means and said anchoring means withdrawn from sealing and anchoring engagement, respectively, with said well conduit, by selected longitudinal movement of said tubing string relative to said well conduit, whereby said thread means disconnects, permitting said first and second components to move away from each other.

38. Well packer apparatus as defined in claim 37 further comprising locking means for preventing said thread means from so disconnecting to permit said first and second components to move away from each other, when said well packer apparatus is in said set condition, until said tubing string is selectively moved longitudinally relative to said well conduit.

39. Well packer apparatus as defined in claim 38 further comprising bypass control means, including bypass seal means and seat means, whereby said secondary flow passage means is in said closed configuration when said bypass seal means is in sealing engagement with said seat means thereby preventing fluid bypass through said secondary flow passage means, and is in said open configuration for bypassing fluids through said well packer apparatus when said bypass seal means is not in sealing engagement with said seat means.

40. Well packer apparatus as defined in claim 39 wherein said secondary flow passage means, in said open configuration, bypasses said packer sealing means between said mandrel and said packer body, said bypass seal means is carried by said mandrel, said seat means is carried by said packer body, and said mandrel is moved longitudinally relative to said packer body between a first position, in which said bypass seal means is in sealing engagement with said seat means and said secondary flow passage means is in said closed configuration, and a second position, in which said bypass seal means is not in sealing engagement with said seat means and said secondary flow passage means is in said open configuration.

41. Well packer apparatus as defined in claim 40 wherein said compensation means comprises:

a. snap lock means, carried by said packer body and including threads, releasably connectible to said mandrel, by engagement of said threads with threads included as part of said mandrel, when said mandrel is in said first position; and b. piston means for acting in combination with said snap lock means; when said snap lock means is so connected to said mandrel, in response to said pressure differentials to increase the forces by which said snap lock means is connected to said mandrel to maintain said mandrel in said first position.

42. Well packer apparatus as defined in claim 41 wherein said seat means is included as part of said piston means.

43. Well packer apparatus as defined in claim 34 further comprising bypass control means, including bypass seal means and seat means, whereby said secondary flow passage means is in said closed configuration when said bypass seal means is in sealing engagement with said seat means thereby preventing fluid bypass through said secondary flow passage means, and is in said open configuration for bypassing fluids through said well packer apparatus when said bypass seal means is not in sealing engagement with said seat means.

44. Well packer apparatus as defined in claim 43 wherein said secondary flow passage means, in said open configuration, bypasses said packer sealing means between said mandrel and said packer body, said bypass seal means is carried by said mandrel, said seat means is carried by said packer body, and said mandrel is moved longitudinally relative to said packer body between a first position, in which said bypass seal means is in sealing engagement with said seat means and said secondary flow passage means is in said closed configuration, and a second position, in which said bypass seal means is not in sealing engagement with said seat means and said secondary flow passage means is in said open configuration.

45. Well packer apparatus as defined in claim 44 wherein said compensation means comprises:

a. snap lock means, carried by said packer body, and including threads, releasably connectible to said mandrel, by engagement of said threads with threads included as part of said mandrel, when said mandrel is in said first position; and b. piston means for acting in combination with said snap lock means, when said snap lock means is so connected to said mandrel, in response to said pressure differentials to increase the forces by which said snap lock means is connected to said mandrel to maintain said mandrel in said first position.

46. Well packer apparatus as defined in claim 45 wherein said seat means is included as part of said piston means.

47. A method of using a packer in a well comprising the steps of:

a. positioning said packer in said well by manipulation of a tubing string connected to said packer;

b. setting said packer in said well by downward movement of said tubing string relative to said well;

c. tightening said packer in set configuration by rotation of said tubing string; and d. selectively opening and closing a bypass flow passage by said packer in set and tightened configuration by limited longitudinal movement of said tubing string relative to said well.

48. A method of using a packer in a well as defined in claim 46 further comprising the step of providing pressure compensation means responsive to pressure differentials across said set packer to increase forces, as said pressure differentials increase, maintaining said tubing string fixed against longitudinal movement relative to said well to selectively maintain said bypass flow passage closed.

49. A method of using a packer in a well as defined in claim 47 further comprising the step of releasing said packer from said set and tightened configuration by longitudinal movement of said tubing string relative to said well.

* * * * *

UNITED STATES PATENT AND TRADEMARK OFFICE

CERTIFICATE OF CORRECTION

PATENT NO. : 4,071,084

DATED : January 31, 1978

INVENTOR(S) : Joe R. Brown and Chudleigh B. Cochran

It is certified that error appears in the above-identified patent and that said Letters Patent are hereby corrected as shown below:

Column 6, line 67, after the number "16", insert the word --which--.

Column 7, line 13, after "J -slot" insert the word --section--.

Column 16, line 22, delete the word "loction" and insert therefor --location--.

Column 18, line 16, delete the word "kep" and insert therefor --keep--.

Column 18, line 60, delete the word "sealig" and insert therefor --sealing--.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*